US005795148A

United States Patent [19]

DiMartino, Sr. et al.

[11] Patent Number: 5,795,148

[45] Date of Patent: Aug. 18, 1998

[54] INDUCED DRAFT FURNACE AIR ADDITION METHOD AND APPARATUS

[75] Inventors: Stephen Paul DiMartino, Sr., Schnecksville, Pa.; Peter George Goldstone, Woking, England; David Brian Letch, Oostvoorne, Netherlands; Nasim Hassan Malik, Wimbeldon, England

[73] Assignee: Air Products and Chemicals, Inc., Allentown, Pa.

[21] Appl. No.: 614,431

[22] Filed: Mar. 12, 1996

[51] Int. Cl.[6] ..... F27B 5/16; F23N 3/00

[52] U.S. Cl. ..... 432/200; 431/20

[58] Field of Search ..... 432/121, 136, 432/143, 144, 145, 146, 147, 200; 454/275; 431/351, 20

[56] References Cited

U.S. PATENT DOCUMENTS

| | | | |
|---|---|---|---|
| 3,426,667 | 2/1969 | Johnson | 454/275 |
| 3,498,205 | 3/1970 | Kautz et al. | 454/275 |
| 4,373,897 | 2/1983 | Torborg | 431/20 |
| 5,070,771 | 12/1991 | Mankowski | 454/275 |

*Primary Examiner*—Henry A. Bennett
*Assistant Examiner*—Gregory Wilson
*Attorney, Agent, or Firm*—Geoffrey L. Chase

[57] ABSTRACT

Method and apparatus for maintaining even heat distribution to each of the tubes contained in a down-fired induced draft furnace by eliminating external atmosphere disturbances such as wind from influencing furnace operation. The top of the furnace is isolated from receiving ambient air except through a central path which controls both rate and direction of air flow.

10 Claims, 2 Drawing Sheets

Fig. 2
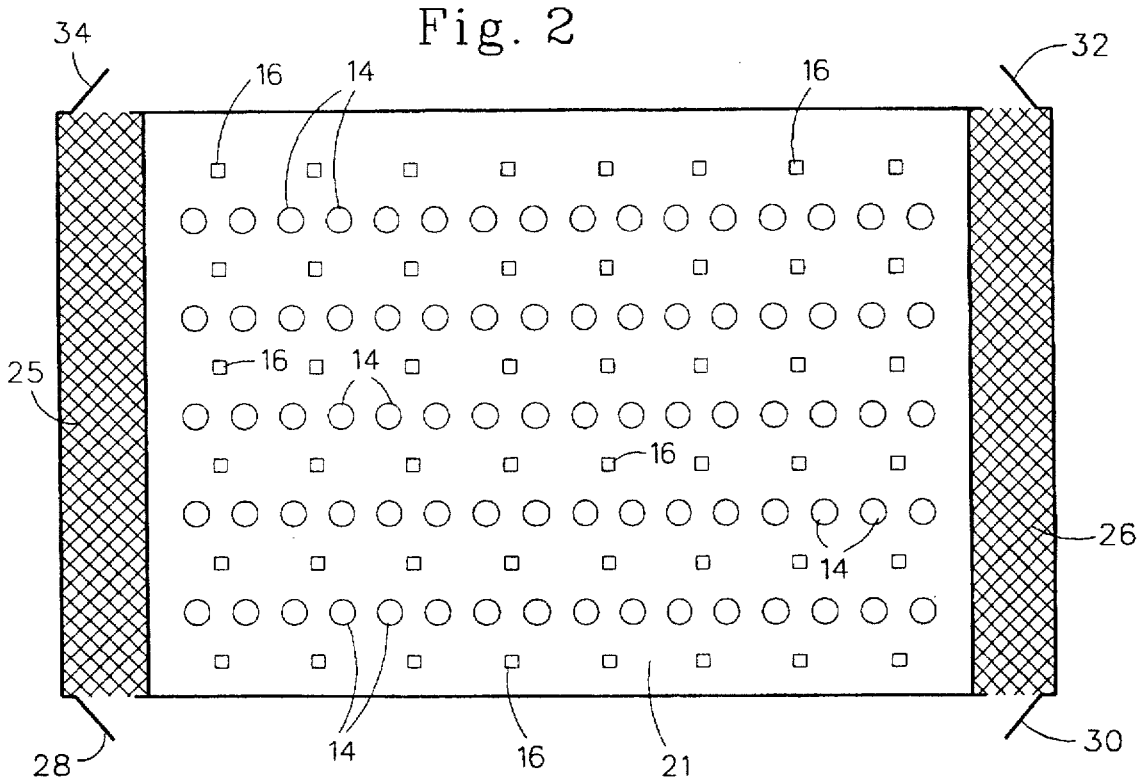
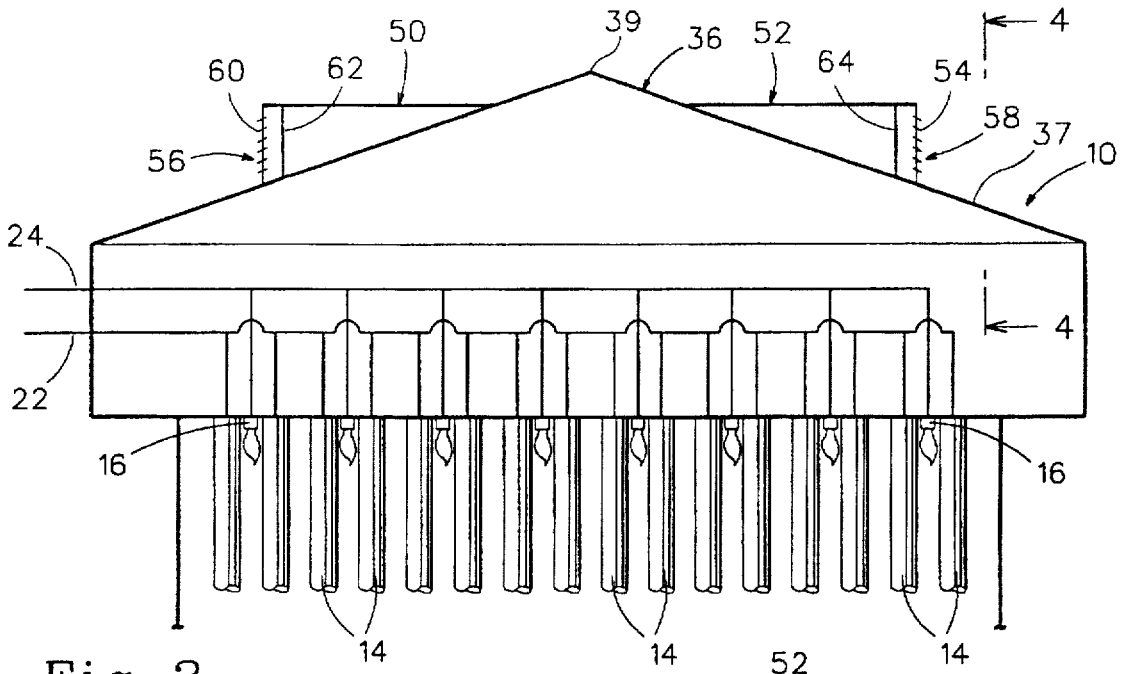
Fig. 3
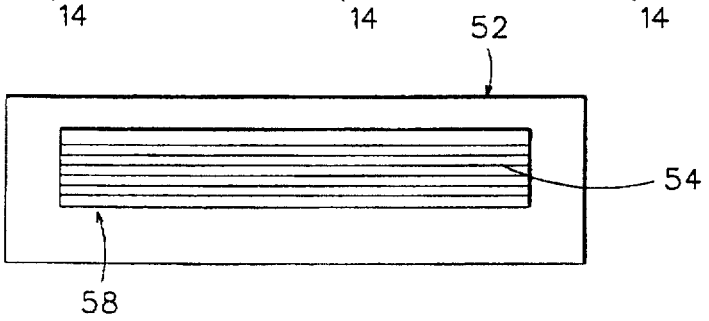
Fig. 4

INDUCED DRAFT FURNACE AIR ADDITION METHOD AND APPARATUS

TECHNICAL FIELD OF THE INVENTION

The present invention pertains to atmospheric control in a down-fired induced draft furnace.

BACKGROUND OF THE INVENTION

Steam-methane reformer furnaces are used to produce, inter-alia hydrogen and carbon monoxide by reforming a hydrocarbon feed with steam and, at times, carbon dioxide at high temperatures. As part of the process a furnace is used to heat the reformer tubes. The furnace used for steam-methane reforming can be configured in several different structures. The burners which provide heat for the endothermic reforming reaction can be located at the top, sides or bottom of the fire box. One of the most conventionally used arrangements for large reformer furnaces has vertical reformer tubes fed from the top which are arranged in rows. Between the rows of reformer tubes are down firing burners to heat the tubes. The burners and the tops of the reformer tubes as well as the supply piping for both the burners and the reformer tubes are contained or enclosed in a structure which is generally referred to as a penthouse. Ambient air to support the combustion passes from the penthouse into the fire box through openings in the burners as is well known in the art. The air enters the penthouse through a grating system that is placed at the same elevation as the penthouse floor and through door openings on the sides of the penthouse.

The problem with a steam-methane reformer using down-fired burners enclosed in a penthouse is that the entire process is subject to the vagaries of ambient wind conditions. If a strong wind is blowing against the penthouse the air flow to the burners will vary considerably. The key to maintaining even heat distribution to each of the reformer tubes is to have the same heat release at each of the burners, except for the outside burners where the heat release is half since the burners only supply heat to one row of tubes rather than two. This is only possible if the same amount of fuel and combustion air is available at each burner. While it is fairly easy to regulate the fuel flow to each burner the air flow can not be easily controlled. Air is drawn into the fire box to each of the burners because the fire box operates at a pressure slightly below atmospheric. It is conventional to operate at an air flow rate about 5–10 percent more than the stoichiometric ratio required to completely combust all of the fuel. The excess air above the stoichiometric amount acts to soak up the heat and maintain the flue gases at constant temperature. If a burner has less air for a given amount of fuel, then the combustion gases from that burner will be at a higher temperature than desired. Conversely, if the air flow increases for the same amount of fuel, then the combustion gases will be at a lower temperature than desired. In a conventional steam-methane reformer each burner has a manual damper to adjust air flow to the burner. The dampers are set at the same point since it is generally assumed that the air pressure in the penthouse will be constant. However, this is not always the case. When there are winds blowing in the area, the air pressure in the penthouse can vary substantially so that the air flow drawn through each burner can vary by 30% or more causing some of the burners to operate at a higher temperature than others since the air is not only part of the combustion process, but it is a diluent to moderate temperature. Small differences in the air pressure in the penthouse can lead to large differences in the air flow to each burner and a consequent large temperature difference in the combustion gases and the reformer tubes. Operating a reformer tube above the desired temperature can cause large decreases in tube life (e.g. a 50° F. increase in temperature can shorten tube life by 25%.) This, in turn will adversely affect the economics of the plant since the tubes are a substantial portion of the overall cost of the plant and require large expenditures of time and effort to replace one that has failed. Another problem caused by uneven air flow across the burners is unstable flame patterns. In extreme cases, the flames will actually impinge on the tubes causing hot spots. Plant operators encountering winds that affect plant operation will turn down the plant to a level where the uneven air pressure in the penthouse will not adversely affect plant performance but will limit capacity. Alternatively the plant operator can accept the prospect of damage to the equipment and keep the plant operating at maximum rate and thus be faced with performing more frequent maintenance.

It is possible under conditions where the wind is at a constant speed and from a constant direction, through extreme care and attention to detail, to adjust each burner's manual damper to a position to balance the air flow through each burner. However, varying winds, especially storm force winds, will negate this strategy and cause constantly shifting pressures within the penthouse. Computational Fluid Dynamics analysis of a typical penthouse generated velocity profiles and pressure contours inside the penthouse for a 35 mile per hour westerly wind demonstrated that, in the existing penthouse structure winds that impinge directly on one of the openings or the face of the building with the grating can cause higher pressure in that area of the penthouse and lower pressure in the opposite area of the penthouse due to eduction effects. This in turn reduces the operating efficiency of the steam-methane reformer.

SUMMARY OF THE INVENTION

The present invention in its broadest aspects solves the problem of the prior art down-fired induced draft furnaces used for, inter-alia, heating reformer tubes. According to the present invention the covering structure, penthouse section, or penthouse of a down-fired induced draft furnace is modified to permit entry of air into the furnace in a controlled manner in order to equalize the air pressure across the entire penthouse and distribute the same amount of air to each of the burners. The penthouse is sealed from ingress of ambient atmosphere and exposure to wind currents or drafts while at the same time a central upper portion of the penthouse is configured to direct air evenly over that portion of the penthouse containing the burners and the upper end of the reformer tubes in a steam-methane reformer utilizing a down-fired induced draft furnace. The penthouse can be modified to contain a central raised portion with generally vertical sidewalls containing louvers with stationary or moveable slats to control air flow into the penthouse. In addition optional vertical baffles can be installed inside the penthouse section of the down-fired induced draft furnace in order to further distribute air flow across the penthouse.

BRIEF DESCRIPTION OF THE DRAWING

FIG. 2 is a section taking along the lines 2—2 of FIG. 1.

FIG. 3 is a fragmentary schematic representation of the reformer furnace of FIG. 1 modified in accordance with the invention.

FIG. 4 is a view taken along the lines 4—4 of FIG. 3.

DETAILED DESCRIPTION OF THE INVENTION

Figure 1:
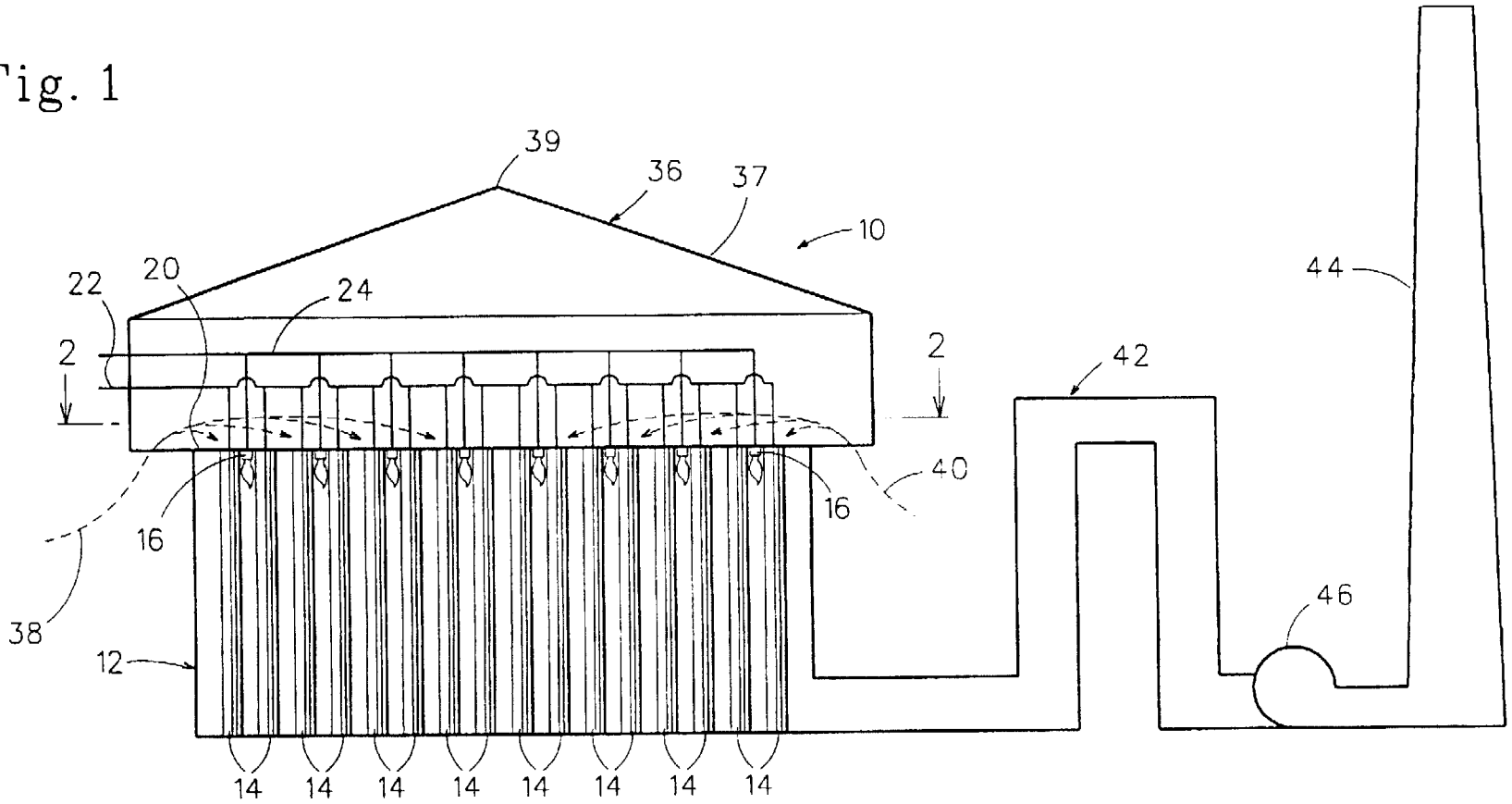
FIG. 1 is a front elevational schematic representation of the equipment arrangement in a down-fired induced draft steam-methane reforming process.

Performance of conventional down-fired induced draft furnaces used for heating reformer tubes can be adversely affected by external atmospheric disturbances, e.g. wind currents or drafts.

Referring to FIGS. 1 and 2 a steam-methane reformer furnace to be modified according to the present invention is shown generally as 10. The reformer 10 has a section 12 which contains a plurality of rows of reformer tubes that extend for the length or a substantial portion thereof of the section 12. Section 12 is variously referred to as the furnace section, burner section, reformer tube housing or fire box of the reformer furnace 10. In between the rows of reformer tubes 14 are rows of burners which are placed at the top 20 of the section 12. Suitable inlet conduits 22 and 24 conduct steam and methane (reactants) to the reformer tubes 14 and fuel to the burners 16 respectively. The top 20 of the section 12 or fire box as it is generally called terminates in a floor like structure 21 as shown in FIG. 2. The floor 21 has side grate like decks 25 and 26 which contain access doorways 28, 30, 32 and 34 respectively. The top section of the fire box 12 is enclosed in a housing or covering structure 36 commonly referred to as a penthouse type structure or penthouse. The penthouse 36 generally has a gable roof 37 having a peak or ridge 39. The burners 16 generally are air-fuel burners which receive air through the gratings 25 and 26 and doorways 28, 30, 32 and 34 in the penthouse 36, the air-flow being shown by flow lines 38 and 40 and the arrows branching off from the flow lines. Contour plots of pressure distribution inside a penthouse such as shown in FIGS. 1 and 2 subject to a 35 mile per hour westerly wind, west being the direction left to right in FIG. 1, show a significant asymmetry of the pressure profile across the penthouse floor. When the present invention is used, the pressure distribution across the penthouse is rendered even and symmetrical despite the direction and velocity of the wind. The fire box 12 includes an exhaust conduit system which permits exhaust to be vented through stack 44 by means of a blower or fan device 46 as is well known in the art.

With the system of FIGS. 1 and 2 if the winds are constant in direction and speed it is possible through extreme attention to detail, for the plant operating staff to adjust the manual damper associated with each burner to a position to balance the air flow through each burner. However, varying winds, especially storm force winds will negate this strategy and cause constantly shifting pressures within the penthouse 36. This leads to non-uniform burner operation and to substantially decreased operating life for the reformer tubes 14.

In most cases reformer operators make no effort to correct the problem. They either run the plant in a turned down mode when severe atmospheric problems occur or continue to operate at high rates and accept the more frequent maintenance requirements for operating under such conditions. Referring to FIGS. 3 and 4 the present invention is a method and apparatus to add combustion air to the penthouse area 36 of reformer 10 in such a manner so that the operation of the reformer is unaffected by wind direction, velocity or variability. According to the present invention the penthouse 36 is modified by sealing the access doorways 28, 30, 32 and 34 and covering the grates 25 and 26 so that ambient air is prevented from entering the penthouse 36. Penthouse 36 is further modified by including in the central upper portion of the roof on either side of the peak 39 of the gable roof 37 two longitudinal dormer like structures 50, 52 which contain louvered openings 56 and 58 disposed in generally vertical sidewalls. The individual slats 54, for louvered opening 58, and the individual slats 60 shown with louvered opening 56 are spaced and positioned so that the air entering the penthouse 36 is uniformly distributed across the floor of the penthouse. The individual slats 54 and 60 can be fixed or moveable. In addition to the louvered openings 56 and 58 internal distribution baffles 62,64 can be placed inside the dormer like structures 50, 52 of penthouse to reduce horizontal air maldistribution. Internal distribution baffles 62 and 64 can be disposed vertically inside the penthouse 36 adjacent the louvered opening 56 and 58. The distribution baffles 62, 64 can be vertical slats or louvers or can be in the form of perforated metal sheets or curtains. The internal distribution baffles' slats may be moveable.

The use of the dormer like structures 50,52 or elongated raised roof sections at the top central portion of the penthouse 36 tends to equalize the pressure across the entire penthouse and keep the air distribution even to all burners. Pressure contour plots by computational fluid dynamics show the pressure distribution inside the penthouse at the floor or burner level under the effect of a 65 mile per hour southwesterly wind is symmetrical and balanced, unlike the prior art. The reformer piping and fuel supply piping as well as the hangers used to support the reformer tubes tend to aid in providing more uniform distribution of the air. The use of moveable slats in at least a portion of the louvered openings 56,58 in the dormer like structures 50,52 can be used to modify the air flow to the penthouse when high winds impinge directly on the louvered openings. This will reduce the momentum of the air introduced into the penthouse and help to better distribute the air. A plant using steam-methane reforming to produce Hydrogen/Carbon Monoxide synthesis gas was modified in accordance with the present invention. Prior to the installation of the present invention wind shields were erected to an attempt to mitigate the effects of wind on the furnace with no appreciable benefit. After installation of the apparatus according to the invention in the plant, the plant experienced wind conditions that would have caused significant problems. However, the plant was able to operate under these conditions without any noticeable adverse effects.

Having thus described our invention what is desired to be secured by letters patent of the united states is set forth in the appended claims.

What is claimed:

1. A method for elimination of external atmospheric disturbances from affecting the performance of a down-fired induced draft furnace wherein air is introduced into burners used in the furnace through a penthouse type structure comprising the step of:

modifying the penthouse type structure to permit entry of said air into said furnace in a manner to equalize pressure of said air across the entirety of said penthouse type structure and distribute said air evenly to all of said burners.

2. A method according to claim 1 wherein said penthouse type structure is modified by preventing ingress of all ambient air except through a central upper portion of a roof of said penthouse type structure.

3. A method according to claim 2 wherein said penthouse type structure is modified by installing two dormer like structures on either side of a peak of a gable roof on said penthouse type structure and installing louvered openings in sidewalls of said dormer like structures.

4. A method according to claim 3 wherein said penthouse is modified by installing internal distribution baffles inside said penthouse type structure to reduce horizontal air maldistribution across a floor of said penthouse.

5. A method according to claim 3 wherein said penthouse is modified by installing moveable slats in said louvered openings of said sidewalls of said dormer like structure.

6. In a down-fired reformer furnace of the type wherein burners are located at the top of the furnace arranged in rows between rows of reformer tubes the improvement comprising:

said furnace having a covering structure enclosing the top section of said furnace having the general configuration of a house with a gable roof said covering structure adapted to prevent ambient air from entering into said covering structure; and means in a central portion on either side of a peak in said gable roof to permit entry of air into said covering structure and said burners in a controlled manner.

7. A furnace according to claim 6 wherein said pitched roof contains a central raised portion extending in a direction generally parallel to said peak of said roof, said raised portion containing sides disposed generally parallel to said peak of said roof, said sides containing louvers to permit air to flow into the top of said furnace.

8. A furnace according to claim 7 including moveable slats in said louvers.

9. A furnace according to claim 6 including means inside said structure enclosing said furnace to prevent maldistribution of air.

10. A furnace according to claim 7 including moveable slats in said louvers and internal baffles inside said covering structure enclosing said furnace.

* * * * *